US005800214A

United States Patent [19]

Pratt et al.

[11] Patent Number: 5,800,214

[45] Date of Patent: Sep. 1, 1998

[54] EDGE CONNECTOR FOR A PRINTED CIRCUIT BOARD

[75] Inventors: Gregory R. Pratt, Naperville; Kent E. Regnier, Lombard, both of Ill.

[73] Assignee: Molex Incorporated, Lisle, Ill.

[21] Appl. No.: 683,551

[22] Filed: Jul. 16, 1996

[51] Int. Cl.[6] ..... H01R 23/70

[52] U.S. Cl. ..... 439/637

[58] Field of Search ..... 439/637, 60, 733.1, 439/444, 630, 633, 634

[56] References Cited

U.S. PATENT DOCUMENTS

| | | | |
|---|---|---|---|
| 4,806,103 | 2/1989 | Kniese et al. | 439/637 |
| 5,378,175 | 1/1995 | Regnier | 439/733.1 |
| 5,411,408 | 5/1995 | DiViesti et al. | 439/637 |
| 5,425,658 | 6/1995 | White | 439/637 |

*Primary Examiner*—Gary F. Paumen
*Assistant Examiner*—Brian J. Biggi
*Attorney, Agent, or Firm*—Charles S. Cohen

[57] ABSTRACT

A push-pull edge card electrical connector is adapted for receiving an edge of a printed circuit board having contact pads on opposite sides of the board adjacent the edge. The connector includes an elongated dielectric housing having a board-receiving face. An elongated slot is disposed in the board-receiving face generally along a longitudinal axis of the housing for receiving the edge of the printed circuit board. A plurality of pairs of transversely spaced terminal-receiving cavities are disposed on opposite sides of the slot defining two rows of cavities lengthwise of the housing. The pairs of transversely spaced cavities are separated by transverse walls extending generally perpendicular to the longitudinal axis of the housing. The housing includes side walls at each pair of transversely spaced terminal-receiving cavities, with the side walls being of different thicknesses along the length thereof to accommodate different shapes of terminals in each pair thereof. A plurality of pairs of first and second shapes of terminals are received in the transversely spaced cavities with one terminal in each pair disposed in a respective one of the transversely spaced cavities. One of the first and second shapes of terminals includes a retention section press-fit between the transverse walls adjacent the thicker of the side walls of different thicknesses. Another feature is that different length preloading walls are provided in the housing for preloading spring contact portions of the terminals.

20 Claims, 10 Drawing Sheets

EDGE CONNECTOR FOR A PRINTED CIRCUIT BOARD

FIELD OF THE INVENTION

This invention generally relates to the art of electrical connectors and, particularly, to a high density edge connector for a printed circuit board.

BACKGROUND OF THE INVENTION

A popular type of electrical connector which is used widely in the electronic industry is called an "edge card" connector. An edge connector receives a printed circuit board having a mating edge and a plurality of contact pads adjacent the edge. Such edge connectors have an elongate housing defining an elongate receptacle or slot for receiving the mating edge of the printed circuit board. A plurality of terminals are spaced along one or both sides of the slot for engaging the contact pads adjacent the mating edge of the board. In many applications, such edge connectors are mounted on a second printed circuit board. The mating edge board or card commonly is called the "daughter" board, and the board to which the connector is mounted commonly is called the "mother" board.

One of the problems with edge connectors of the character described above centers around the ever-increasing demands for high density electronic circuitry. The terminals of such a connector are mounted in a housing fabricated of dielectric material such as plastic or the like. Not only are the terminals becoming ever-increasingly miniaturized, but their density within the housing is becoming greater and greater. The terminals are mounted in rows along the slot of the housing, with the terminals being separated by a dielectric partition or wall integral with the housing, and the housing includes side walls for surrounding the terminals. The parameters of providing a very high density connector results in the housing portions between and around the terminals becoming extremely thin. Not only does this result in the housing portions potentially providing insufficient support for the terminals, but the stresses placed on the housing due to the engagement of the terminals with an inserted circuit board may result in the housing becoming warped, bent, or otherwise disfigured. Other problems with the connector housing and its structural features for accommodating specific shapes of terminals usually revolve around the small dimensional parameters required.

In order to increase the density of terminals in edge connectors, it has become known to design the connector as a bi-level connector. In such bi-level connectors, terminals are provided with contact portions that contact the daughter printed circuit board at two locations or at two levels relative to the mating edge of the board. Often, the different terminals are in an alternating arrangement along the length of the card-receiving slot in the connector housing and may be in two rows along opposite sides of the slot.

The problems outlined above are further complicated when certain features, parameters or characteristics are desired to be incorporated in the array of terminals along the edge card slot. For instance, it may be desirable to provide all of the terminals with equal electrical path lengths regardless of the particular shape of the terminals. It usually is desirable for the tips of the tail portions of all of the terminals to be generally coplanar. It also may be desirable to have the tail portions of the terminals staggered in at least two rows along the length of the connector in order to increase the density of the "footprint" of circuit traces, pads or holes on or in the mother printed circuit board. Finally, it may be desirable for each of the terminals to exert an equal force on the daughter printed circuit board.

This invention is directed to improvements in such edge connectors, particularly in the structural relationship between the dielectric housing and the terminals, including improvements directed to solving the above problems.

SUMMARY OF THE INVENTION

An object, therefore, of the invention is to provide a new and improved edge connector for a printed circuit board.

In particular, the invention is directed to applications wherein the printed circuit board has a mating edge and a plurality of contact pads on one or both opposite sides of the board adjacent the edge.

In the exemplary embodiment of the invention, the edge connector includes an elongate dielectric housing having a board-receiving face. An elongated slot is disposed in the board-receiving face generally along a longitudinal axis of the housing for receiving the edge of the printed circuit board. A plurality of pairs of transversely spaced apart terminal-receiving cavities are provided on opposite sides of the slot defining two rows of cavities lengthwise of the housing. The pairs of transversely spaced cavities are separated by transverse walls extending generally perpendicular to the longitudinal axis. A plurality of terminals are received in the transversely spaced terminal-receiving cavities. The terminals are in pairs for engaging contact pads on opposite sides of the printed circuit board. One terminal in each pair is disposed in a respective one of the transversely spaced terminal-receiving cavities. The housing includes side walls at each pair of transversely spaced terminal-receiving cavities, with the side walls being of different thicknesses along the length thereof to accommodate different shapes of terminals in each pair thereof. The differing thickness of the side walls alternate lengthwise of the housing along each row of cavities. Each pair of terminals includes first and second shapes of terminals alternating lengthwise of the housing in each row of cavities. One of the first and second shapes of terminals includes retention sections press-fit between the transverse walls adjacent the thicker of the side walls of different thicknesses.

Another feature of the invention is the provision of means in each pair of cavities for preloading the different first and second shapes of terminals. In particular, the first and second shapes of terminals have different spring contact portions in each pair of terminals. The spring contact portions of the different shapes of terminals extend different distances from the bottom of the board-receiving slot. The preloading means are provided by preloading walls extending inwardly into the cavities from the terminating face of the housing, with the preloading walls being of different lengths to accommodate the different spring contact portions of the first and second shapes of terminals.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
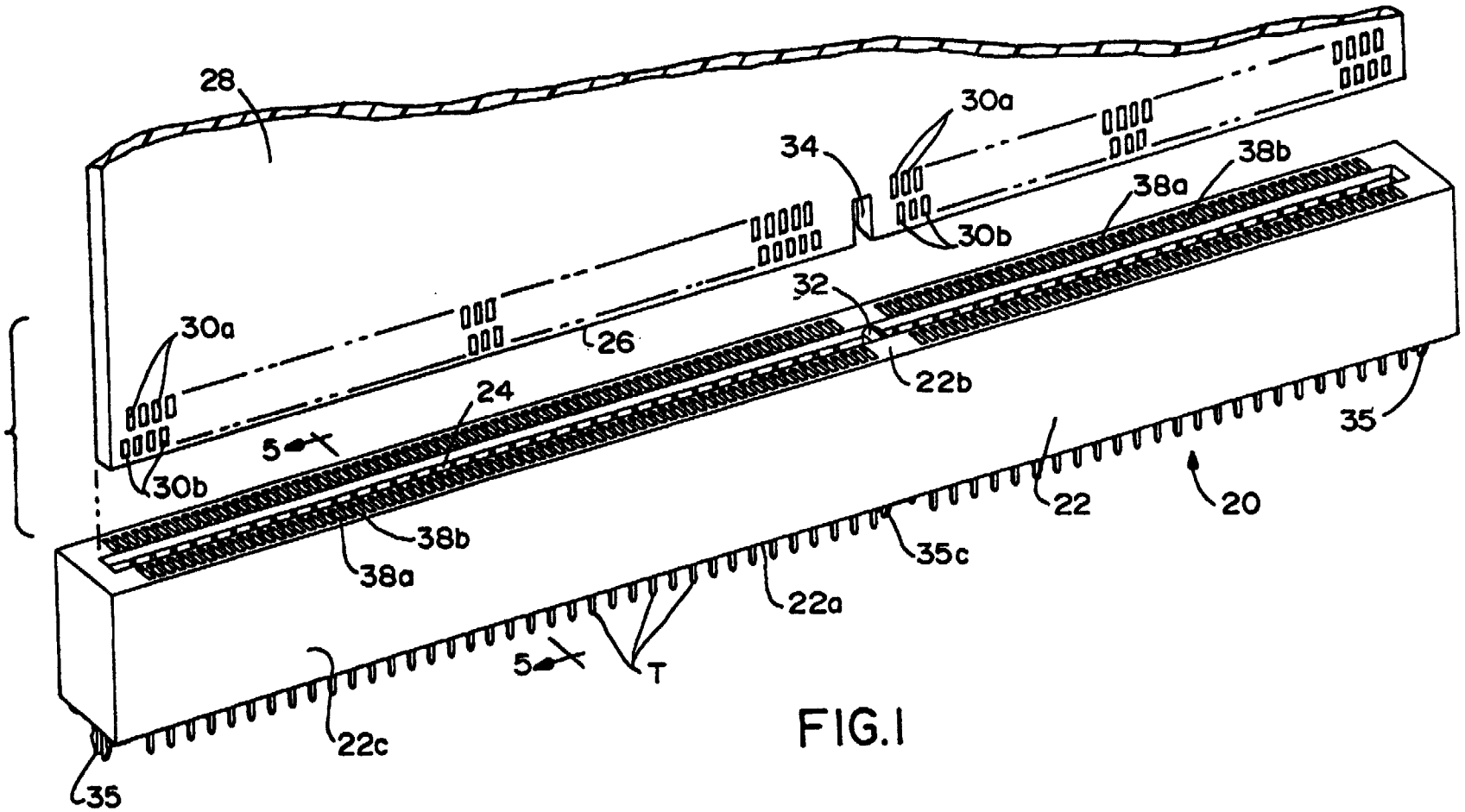
FIG. 1 is a perspective view of an electrical connector for incorporating electrical terminals fabricated according to the invention, in conjunction with a fragmented depiction of an edge of a printed circuit board insertable into the connector.

Referring to the drawings in greater detail, and first to FIGS. 1–4, an elongated electrical connector, generally designated 20, of the edge card type is shown. The connector is typical of this type of electrical connector in that it includes a unitarily molded, elongate housing 22 defining a board-mounting or terminating face 22*a* and a board-receiving face 22*b*. The board-receiving face 22*b* includes an elongate receptacle or card slot 24 for receiving a mating edge 26 of a printed circuit board 28. A plurality of terminals (described hereinafter) are spaced along both sides of slot 24 for engaging contact pads 30*a* and 30*b* adjacent mating edge 26 on both sides of printed circuit board 28. It can be seen that contact pads 30*a* and 30*b* are in two rows, with the row of contact pads 30*b* being closer to edge 26 than the row of contact pads 30*a*. Each of the rows 30*a* and 30*b* is generally parallel to mating edge 26. Lastly, a polarizing rib 32 spans slot 24 for insertion into a polarizing notch 34 in edge 26 of the printed circuit board to ensure the board is properly oriented endwise within the slot relative to the elongate connector.

In many applications, edge card connectors, such as connector 20, are mounted on a second printed circuit board. The mating circuit board 28 commonly is called the "daughter" board, and the board 29 (FIG. 5) to which the connector is mounted commonly is called the "mother" board. Connector 20 is of this type and includes three boardlocks 35 (the middle boardlock is labeled 35*c* for insertion into appropriate mounting holes in the mother board. A plurality of standoffs 36 project downwardly from board-mounting face 22*a* of housing 22 a predetermined distance to space the housing from the mother board upon placement thereon.

Figure 3:
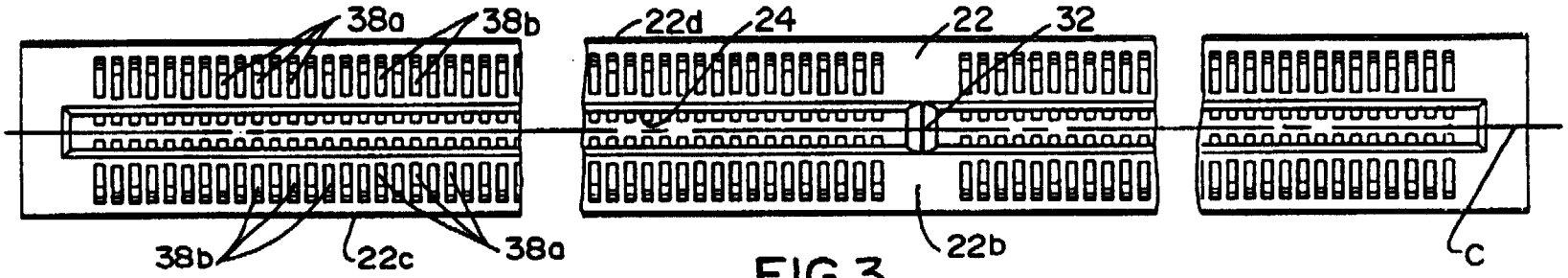
FIG. 3 is a fragmented top plan view of the connector housing of FIG. 2.
Figure 2:
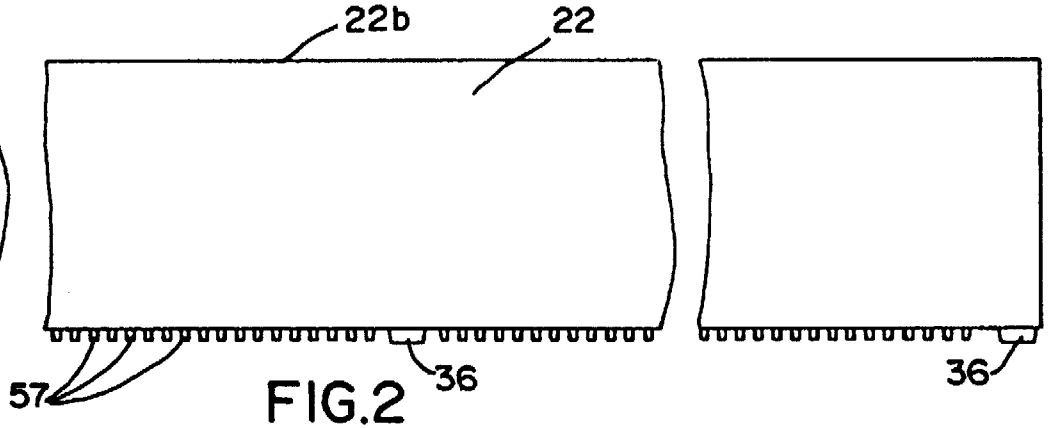
FIG. 2 is a fragmented front elevational view of the connector housing.

FIGS. 1 and 3 best show that elongate housing 22 of connector 20 has two rows of terminal-receiving cavities or passages extending lengthwise of the housing generally parallel to the longitudinal axis of the housing, one on each of opposite sides of card slot 24. Each row includes an alternating series of differently shaped first and second cavities 38*a* and 38*b*. In addition, the shapes within one row are offset relative to the other row by the distance between adjacent cavities. As a result, each first cavity 38*a* has a differently shaped second cavity 38*b* on both sides of it within its row and as well as an additional second cavity 38*b* laterally across card slot 24 in the other row of cavities.

Figure 4:
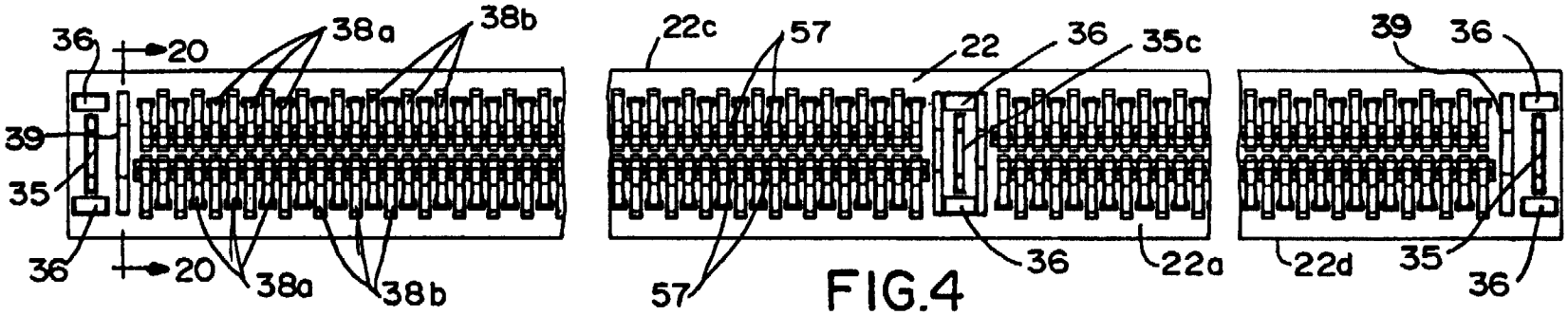
FIG. 4 is a fragmented bottom plan view of the connector housing of FIG. 2.
Figure 5:
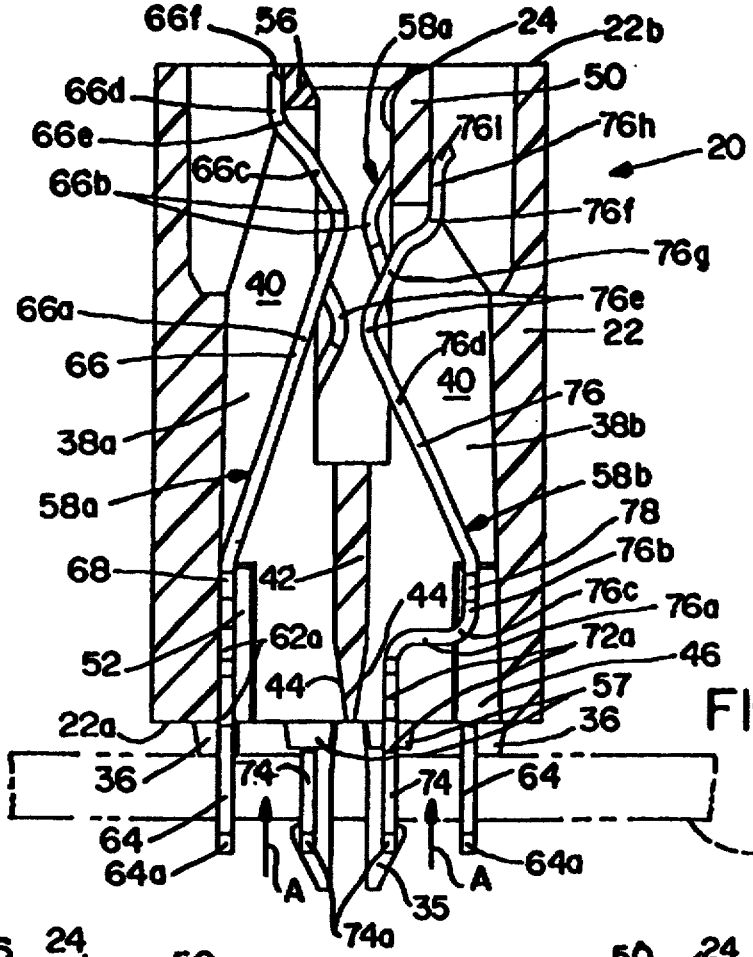
FIG. 5 is an enlarged vertical section taken generally along line 5—5 of FIG. 1.
Figure 6:
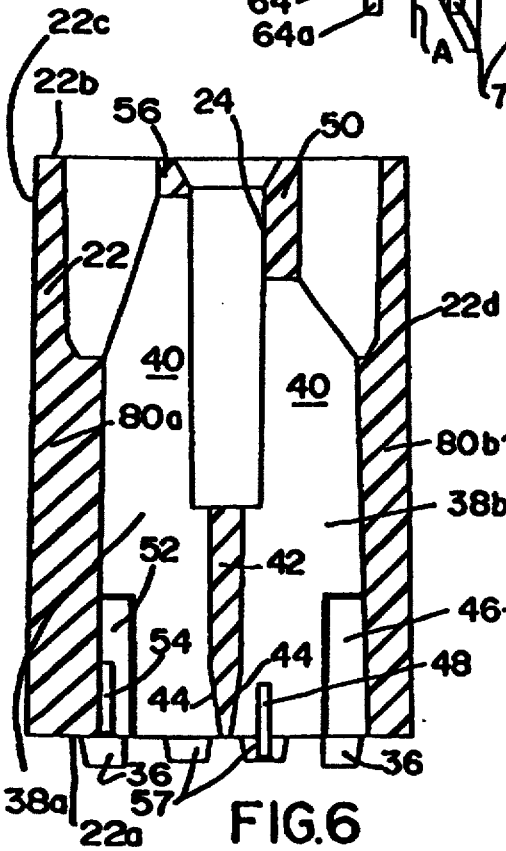
FIG. 6 is a view similar to that of FIG. 5, but with the terminals removed.
Figure 7:
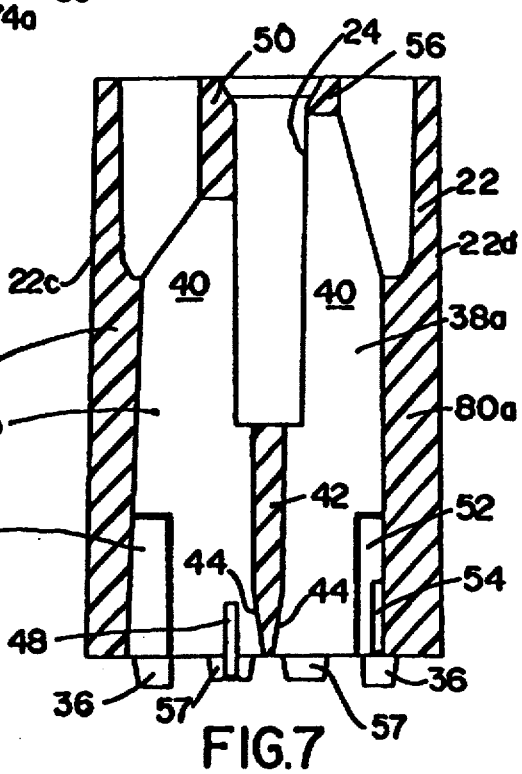
FIG. 7 is a vertical section through the housing similar to FIG. 6, but of an adjacent pair of terminal-receiving cavities.

More particularly, referring to FIGS. 5–7 in conjunction with FIGS. 1–4, housing 22 includes a series of the pairs of first and second cavities 38*a* and 38*b* with one pair of the cavities shown in each of FIGS. 5, 6 and 7. FIGS. 5 and 6 show first cavity 38*a* on the left-hand side of slot 24 with second cavity 38*b* on the right-hand side of the slot. Conversely, FIG. 7 shows one of the first cavities 38*a* on the right-hand side of slot 24, whereas second cavity 38*b* is shown on the left-hand side of the slot. These depictions in the drawings illustrate that the first and second cavities 38*a* and 38*b* alternate lengthwise of the connector housing on opposite sides of the slot. All of the adjacent cavities in each row thereof are separated lengthwise along the housing by transverse walls 40.

Still referring to FIGS. 5–7, a reinforcing rib 42 is disposed in the lower half of the housing separating the two cavities 38*a* and 38*b* in each pair thereof. The reinforcing ribs 42 not only separate the cavities, but also span the cavities and are integrally molded between transverse walls 40 to provide support for the walls and allow the walls to be molded as thin as possible, thereby enhancing the high density nature of the connector. All of the reinforcing ribs between adjacent cavities 38*a* and 38*b* are located along a longitudinal centerline "C" of housing 22 (FIG. 3) immediately below slot 24 as can be seen by comparing FIGS. 6 and 7. Lastly, each reinforcing rib 42 is tapered, as at 44, at its bottom end to provide a camming surface for engaging the terminals and assisting during insertion of the terminals into first and second cavities 38*a* and 38*b*, as described hereinafter. Therefore, it can be understood that reinforcing ribs 42 perform a multitude of functions.

Each second cavity 38*b* includes an enlarged recess 46 and an inner press-fit terminal retention slot 48 in each of its transverse walls 40, as well as an upper preloading wall 50, all for different purposes in cooperating with a respective terminal inserted into the cavity. Similarly, each cavity 38*a* includes an enlarged recess 52 and an outer press-fit terminal retention slot 54 in its transverse walls 40, as well as a preloading wall 56, again for cooperating with a respective terminal inserted into the cavity. It can be seen that preloading wall 56 of cavity 38*a* is shorter than preloading wall 50 of cavity 38*b*.

A plurality of retention bosses 57 are molded integrally with housing 22 in alignment with terminal-receiving cavities 38b whereby the cavities extend through the retention bosses. Actually, the retention bosses are "split" portions of housing 22 projecting downwardly from transverse walls 40 on opposite sides of terminal-receiving cavities 38b adjacent the lower portions of the retention sections of the terminals received in the cavities as described below. As best seen in FIG. 5, the standoffs 36 extend downward from board-mounting face 22a of housing 22 slightly further than retention bosses 57 extend downward. As a result, the retention bosses will not contact printed circuit board 29 when the connector 20 is mounted thereon.

Figure 20:
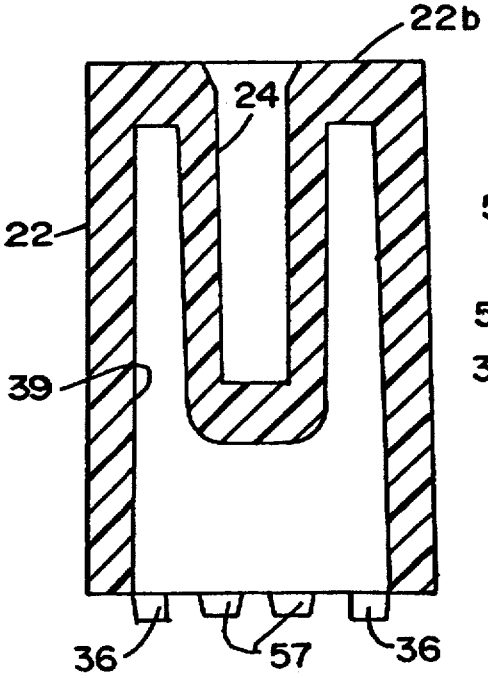
FIG. 20 is an enlarged vertical section taken generally along line 20—20 of FIG. 4.

As shown in FIGS. 4 and 20, a recess 39 is located adjacent the opposite ends of the rows of terminal receiving cavities 38a and 38b. In addition, a pair of recesses 39 are located on opposite sides of center boardlock 35c which is aligned with and positioned below polarizing rib 32. These recesses 39 extend laterally from the longitudinal axis of the housing at least as far as the terminal receiving cavities 38a and 38b, and preferably slightly further. In the vertical direction, they extend in a manner similar to cavities 38a and 38b although they do not extend through board-receiving face 22b of the housing. These recesses 39 provide additional flexibility to the plastic housing at the inner and outer press-fit slots 48 and 54 adjacent the ends of the housing and the center boardlock 35c in order to reduce the likelihood of cracking of the housing. In addition, they also reduce shrinkage of the plastic.

Generally, electrical connector 20 includes a series of simple cantilevered beam terminals along each side of slot 24. The terminals of such series include first and second shapes, generally designated 58a and 58b, respectively, that are inserted into cavities 38a and 38b, respectively, in the direction of arrows "A" (FIG. 5).

Figure 8:
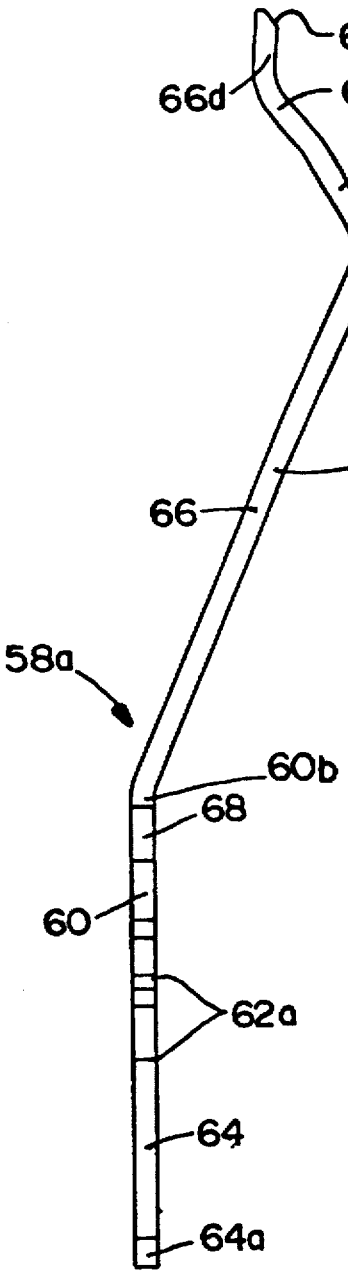
FIGS. 8 and 9 are side elevational and plan views, respectively, of one of the two different shapes of terminals.
Figure 9:
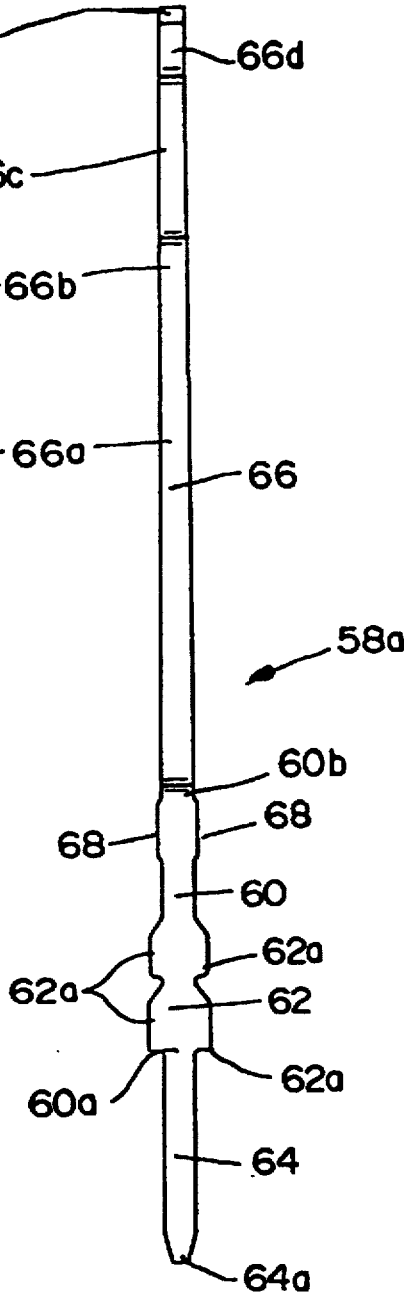

More particularly, referring to FIGS. 8 and 9 in conjunction with FIG. 5, first terminal 58a insertable into a respective one of the cavities 38a includes a generally planar base portion 60 having a retention section 62 with outwardly projecting barbs 62a (FIG. 9) on opposite side edges thereof. A tail portion 64 projects from one end 60a of base portion 60 and includes a tapered tip 64a. A resilient spring arm or beam 66 extends from a second, opposite end 60b of the base portion at approximately a 24° angle thereto. The spring arm includes a first generally straight section 66a that extends up to an inwardly bowed contact section 66b, which projects into slot 24 as best seen in FIG. 5. Although difficult to see in the drawings, straight section 66a is tapered so it is widest adjacent base 60 and narrowest adjacent contact section 66b. This reduces stress concentrations in the arm 66. A relatively steep lead-in section 66c is positioned above contact section 66b with a generally vertical upper arm section 66d adjacent the end of arm 66. A generally arcuate transition section 66e extends between lead-in section 66c and upper arm section 66d in order to permit the lead-in section to have its desired angle relative to vertical to provide a low insertion force yet position upper arm section 66d generally vertically to engage preloading wall 56. As best seen in FIG. 5, the lead-in section 66c extends from slot 24 slightly into cavity 38a to ensure that the edge 26 of card 28 initially engages lead-in section 66c. Finally, the tip 66f of arm 66 is coined or chamfered to prevent stubbing while inserting the terminal 58a into cavity 38a during the assembly process.

Finally, FIG. 9 shows a pair of protrusions 68 at opposite side edges adjacent second end 60b of base portion 60 which are the result of severing the terminal from a mid-carrier strip 82 (described hereinafter). In essence, these protrusions comprise cutoffs of the carrier strip. When each terminal 58a is inserted into its respective cavity 38a, cutoffs 68 are aligned with enlarged recesses 52. The recesses are sufficiently large and deep enough to prevent any interference with the cutoffs and to allow free movement during insertion of the terminal into the housing in the area of the cutoffs.

Figure 10:
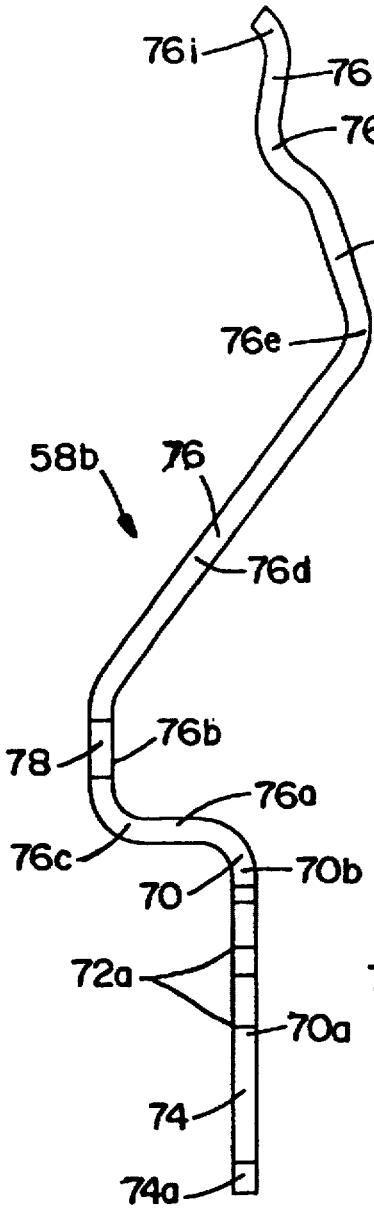
FIGS. 10 and 11 are side elevational and plan views, respectively, of the second shape of terminals.
Figure 11:
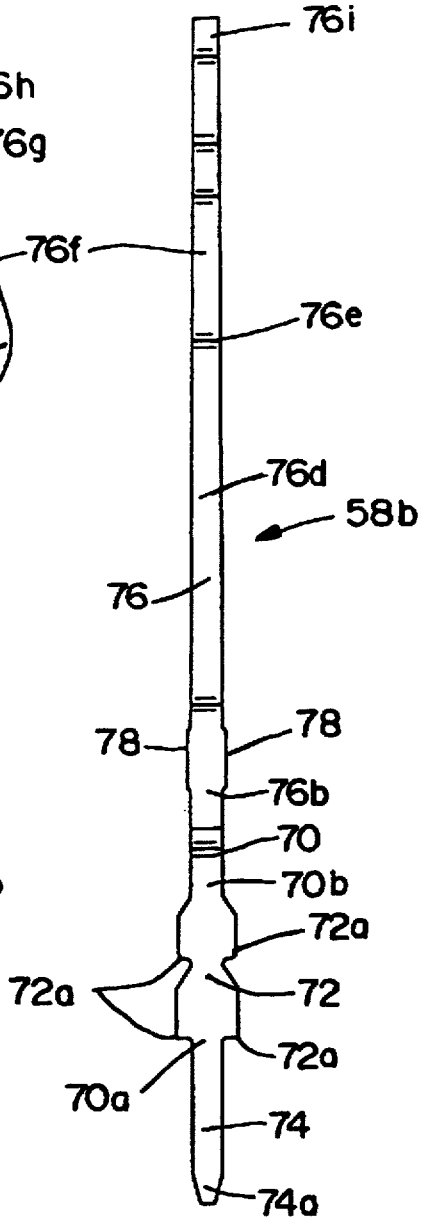

Referring to FIGS. 10 and 11 in conjunction with FIG. 5, each of the second terminals 58b includes a generally planar base portion 70 having a retention section 72 which includes barbs 72a at opposite side edges thereof. A tail portion 74 projects from one end 70a of base portion 70 and includes a tapered tip 74a. A resilient spring arm or beam 76 extends from a second, opposite end 70b of the base portion 70. The spring arm 76 includes a generally horizontal first section 76a extending from the base at approximately a 90° angle thereto and leads to a generally vertical second section 76b with an arcuate lower transition section 76c therebetween. A generally straight third section 76d extends from vertical section 76b at approximately a 38° angle thereto and ends in an inwardly bowed contact section 76e. Although difficult to see, such third section is tapered to reduce stress concentrations within the beam. A relatively steep lead-in section 76f extends away from contact section 76e where it intersects with an arcuate upper transition section 76g. As best seen in FIG. 5, lead-in section 76f extends from slot 24 slightly into cavity 38b to ensure that the edge 26 of card 28 initially engages lead in-section 76f. A generally vertical upper arm 76h for engaging preload wall 50 extends upwardly from upper transition section 76g and ends in curved or arcuate tip 76i. The curved tip minimizes the likelihood of stubbing of the terminal while inserting the terminal 58b into cavity 38b during the assembly process.

Somewhat similar to first terminal 58a, each second terminal 58b also includes mid-carrier cutoffs 78 which become located between enlarged recesses 46 of the respective cavity. The recesses 46 are sufficiently large and deep to allow for free movement of horizontal section 76a and vertical section 76b relative to the housing both during insertion of the terminal into the housing as well as operatively when fully inserted therein and a daughter printed circuit board 28 is inserted into slot 24.

In comparing FIGS. 6 and 7, it can be seen that housing 22 has side walls 22c and 22d bounding the outsides of cavities 38a and 38b. Since the cavities 38a and 38b alternate along the length of housing 22, the thickness of side walls 22c and 22d also alternate along the length of the housing. The thicker portion of the side walls 22c and 22d is designated 80a and associated with cavity 38a while the thinner portion is designated 80b and associated with cavity 38b. The thickened portion 80a of the side wall provides additional support for transverse walls 40 of cavity 38a as the retention section of terminal 58a is press-fit into slots 54 in the transverse walls. In fact, it can be seen in FIGS. 6 and 7 that press-fit slots 54 are located immediately adjacent the thickened portions 80a of the side walls. As such, it can be seen in FIG. 5 that base 60 of first terminal 58a is next to and supported by the thicker portion 80a of the side wall on one side. This assists in preventing movement of any portion of the terminal except spring arm 66.

Figure 19:
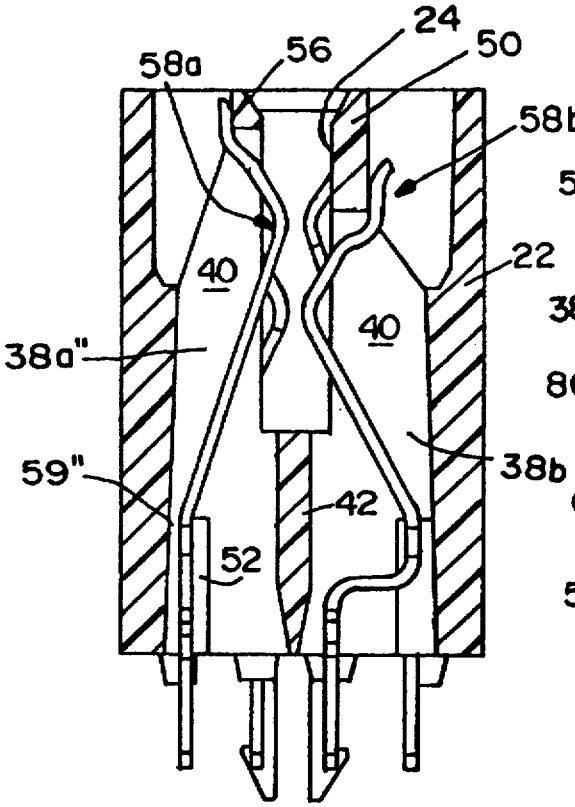
FIG. 19 is an enlarged vertical section similar to FIG. 5 showing still another alternate embodiment of the connector housing.
Figure 17:
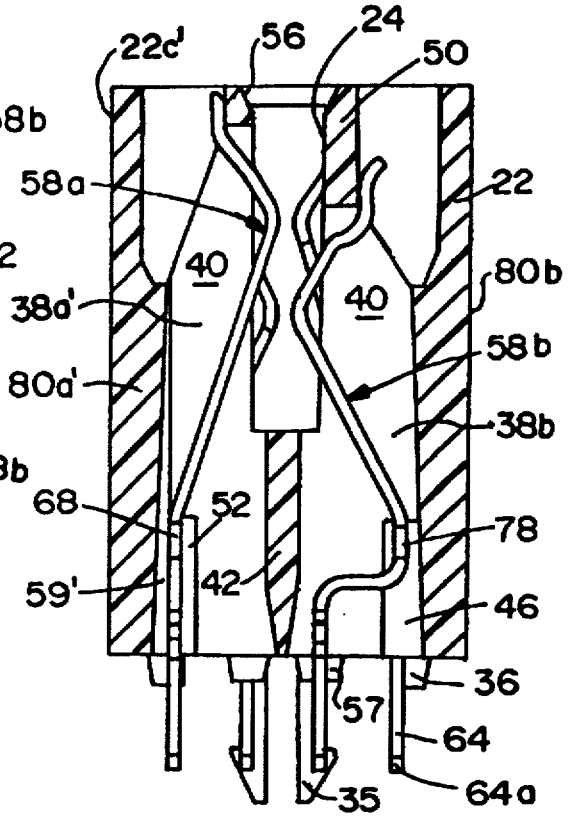
FIG. 17 is an enlarged vertical section similar to FIG. 5 showing an alternate embodiment of the connector housing.
Figure 18:
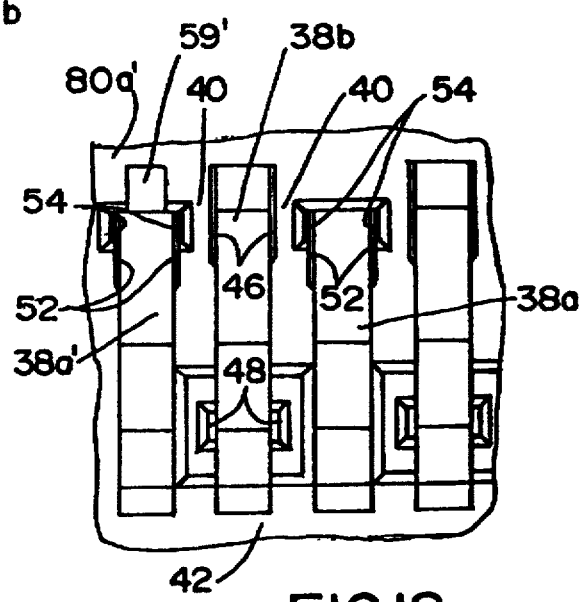
FIG. 18 is an enlarged fragmented bottom plan view of a portion of the connector housing showing a plurality of terminal receiving cavities and one cavity modified as shown in FIG. 17.

FIGS. 17 and 18 show an alternate embodiment wherein a modified first cavity 38a' extends slightly further into sidewall 22c' as compared to an unmodified first cavity 38a. This provides additional flexibility at the end of transverse wall 40 adjacent side wall 22c'. The extension 59' of cavity 38a' can best be seen in FIG. 18 wherein a second cavity 38b is shown between a modified first cavity 38a' and an unmodified first cavity 38a. The width of the extension 59' between transverse walls 40 is less than the width of the main portion of cavity 38*a*'. In the alternative, as shown in FIG. 19, the extension 59" could be widened so that the width between the transverse walls 40 is uniform throughout cavity 38*a*", including extension 59". In either case, since the width of the extension 59" is still less than the distance across cutoffs 68, terminal 58*a* is still supported along base 60 to prevent outward deflection thereof.

It can be seen in FIG. 5 that the tips 64*a* of tail portions 64 of terminals 58*a* and the tips 74*a* of tail portions 74 of terminals 58*b* all substantially lie in a common plane generally parallel to the mother board 29. In use, all of the tails will be inserted into holes in the mother board and, generally, the circuit traces on the mother board are generally coplanar. It is desirable to have the electrical paths through both shapes of terminals 58*a* and 58*b* be of equal lengths, while still having the terminals engage the contact pads 30*a* and 30*b* (FIG. 1) along edge 26 of printed circuit board 28 at two different levels, as described above. It can be seen that contact sections 66*b* of terminals 58*a* engage contact pads 30*a* at a different level than contact sections 76*e* of terminals 58*b*. This permits an increase in density of the terminals without substantially increasing the insertion forces. Although the contact sections 76*e* of terminals 58*b* are closer vertically to mother board 29 than the contact sections 66*b* of terminals 58*b*, the electrical paths through the terminals between the contact sections and the tips of the tails are substantially equal. In addition, the specific shapes of the spring arms of terminals 58*a* and 58*b* provide for substantially similar normal forces on contact pads 30*a* and 30*b* since the spring arms have substantially similar spring rates and are deflected equal amounts.

During assembly, the terminals 58*a* and 58*b* are inserted into their respective cavities 38*a* and 38*b* from the bottom or terminating face 22*a* of the housing. As the terminals enter their respective cavities, their respective contact section 66*b* and 76*e* initially contact the tapered lower portion 44 of center reinforcing rib 42 that separates the two cavities 38*a* and 38*b*. The contact sections 66*b* and 76*e* slide along the center rib 42 until they reach slot 24. A tool (not shown) generally shaped like edge card 28 is positioned within slot 24 in order to further deflect the contact arms 66 and 76 of the two terminals 58*a* and 58*b*. By engaging this tool, the generally vertical upper arms 66*d* and 76*h* of the two terminals are properly positioned so that they will slide behind their respective preloading walls 56 and 50.

As the terminals are inserted into their respective cavities, their respective cutoffs 68 and 78 enter recesses 52 and 46. Since the distance between the recesses 52 in the transverse walls 40 on opposite sides of cavity 38*a* is greater than the width across cutoffs 68, the cutoffs 68 do not bind or engage the recesses during insertion. Likewise, the distance between transverse walls 40 at recesses 46 is larger than the distance across cutoffs 78 so that the cutoffs 78 also do not bind or engage the walls of the recesses during insertion of the second terminals 58*b*. As the first terminal 58*a* is inserted into its final position, retention section 62, including barbs 62*a*, are press-fit into outer retention slot 54 (FIG. 6). During such insertion, the barbs 62*a* skive or dig into the side walls of the slot 54 to retain the terminal within the housing. Likewise, during insertion of second terminal 58*b*, the retention section 72, including barbs 72*a*, are press-fit into inner retention slot 48. During such insertion, the barbs 72*a* also skive or dig into the side walls of slot 48 to retain the terminal 58*b* within the housing.

Figure 12:
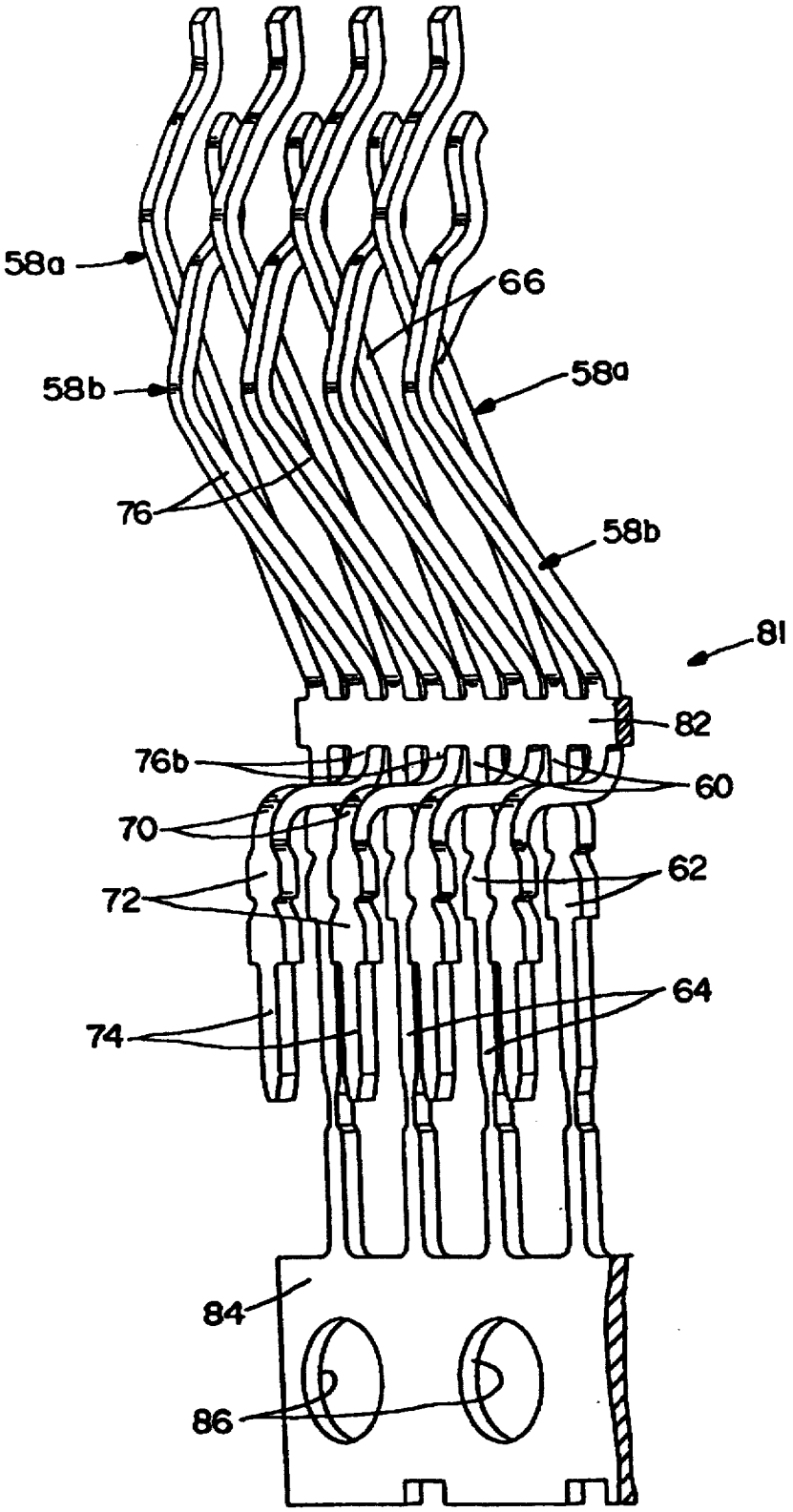
FIG. 12 is a fragmented perspective view of an elongate strip of electrical terminals still interconnected by the main carrier strip and the mid-carrier strip.

FIG. 12 shows the different shapes of terminals 58*a* and 58*b* after fabrication and as integral components of a stamped and formed elongate strip of electrical terminals, generally designated 81. First and second terminals 58*a* and 58*b*, respectively, alternate lengthwise of elongate strip 81. The series of alternating terminals are joined by a mid-carrier strip 82 and a second carrier strip 84.

Still referring to FIG. 12, mid-carrier strip 82 joins first and second terminals 58*a* and 58*b*, respectively, at the base portions 60 of the first terminals 58*a* and the vertical sections 76*b* of the spring arm 76 of the second terminals 58*b*. This mid-carrier strip 82 facilitates forming of the lower portion of second terminals 58*b*, as described in greater detail below.

Second carrier strip 84 is used in a conventional manner to index the strip of terminals through appropriate processing machines. To that end, carrier strip 84 includes a plurality of indexing holes 86 as is known in the art. It should be noted that carrier strip 84 interconnects only alternating ones of the tail portions of the terminals, namely, tail portions 64 of each of first terminals 58*a*.

Figure 13:
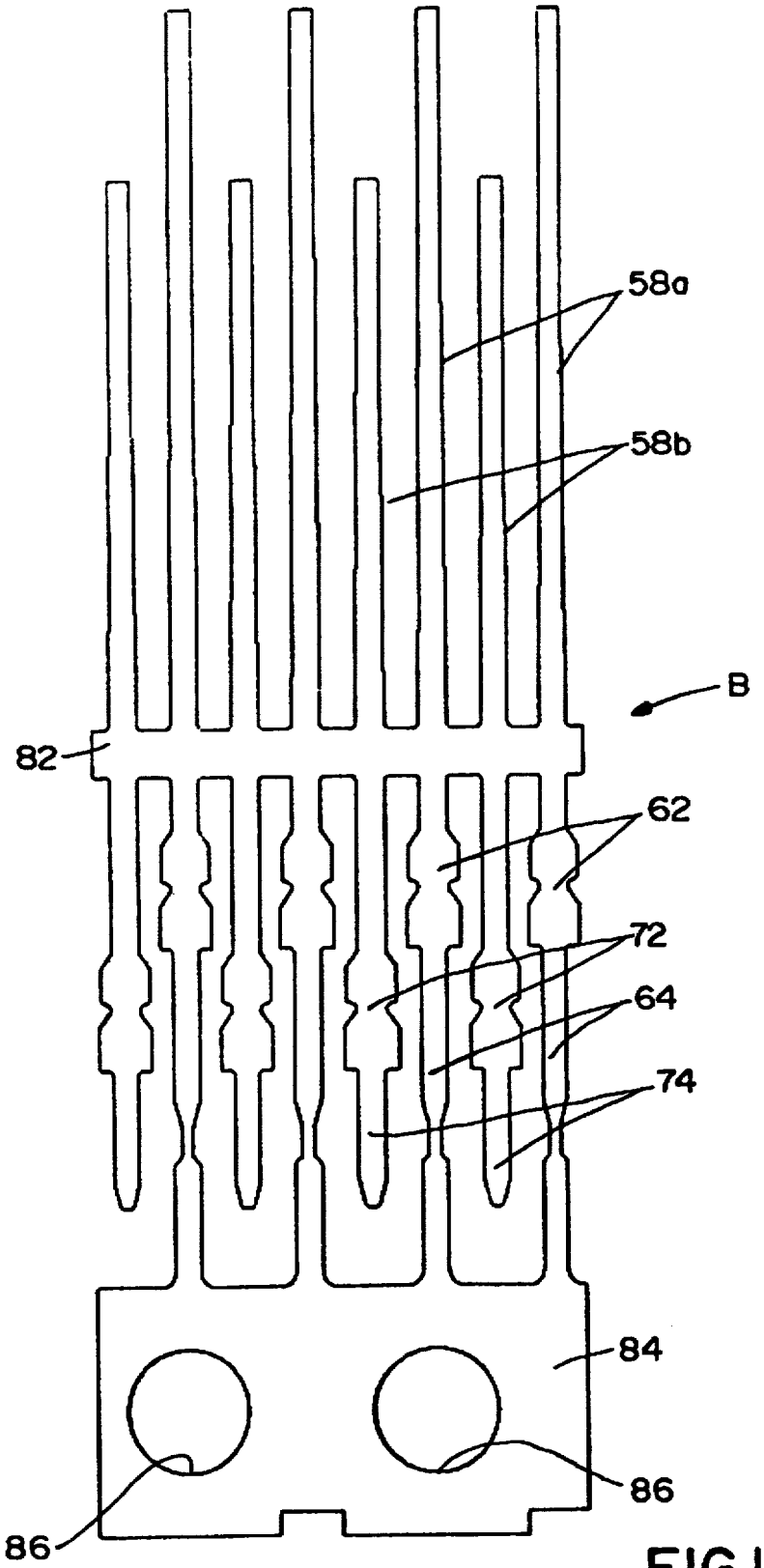
FIG. 13 is a plan view of the elongate strip of terminals after just the stamping step and prior to being formed into the configuration of FIG. 12.

FIG. 13 shows the stamping step in the method of fabricating elongate strip 81 (FIG. 12) of electrical terminals 58*a* and 58*b* prior to forming such terminals. In particular, FIG. 13 shows a flat blank "B" which has been stamped of sheet metal material. The flat outline of terminals 58*a* and 58*b* can be seen in FIG. 13, before the terminals are formed, and with the terminals alternating along the elongate strip and joined by mid-carrier strip 82 and second carrier strip 84. This view clearly shows how the second carrier strip is joined to the tips 64*a* of tail portions 64 of only the first shape of terminals 58*a*. This allows the portions of terminals 58*b* below the mid-carrier strip 82 to move freely during the forming operation relative to the second carrier strip 84.

Figure 15:
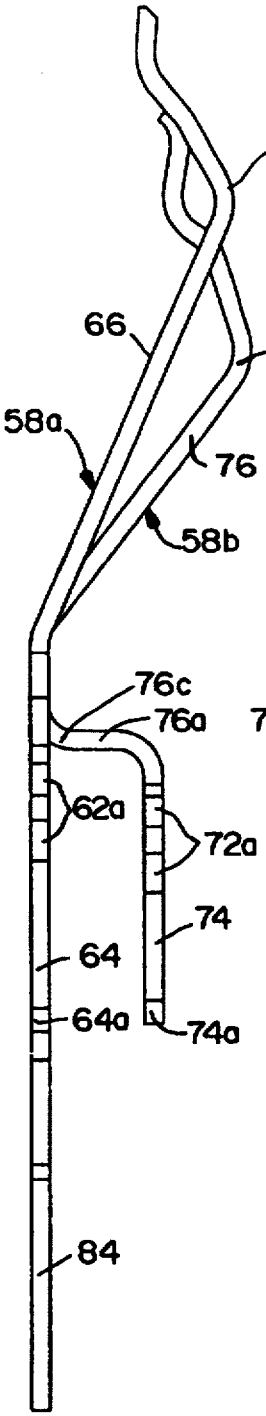
FIG. 15 is a side elevational view of the elongate strip of terminals in FIG. 14.
Figure 14:
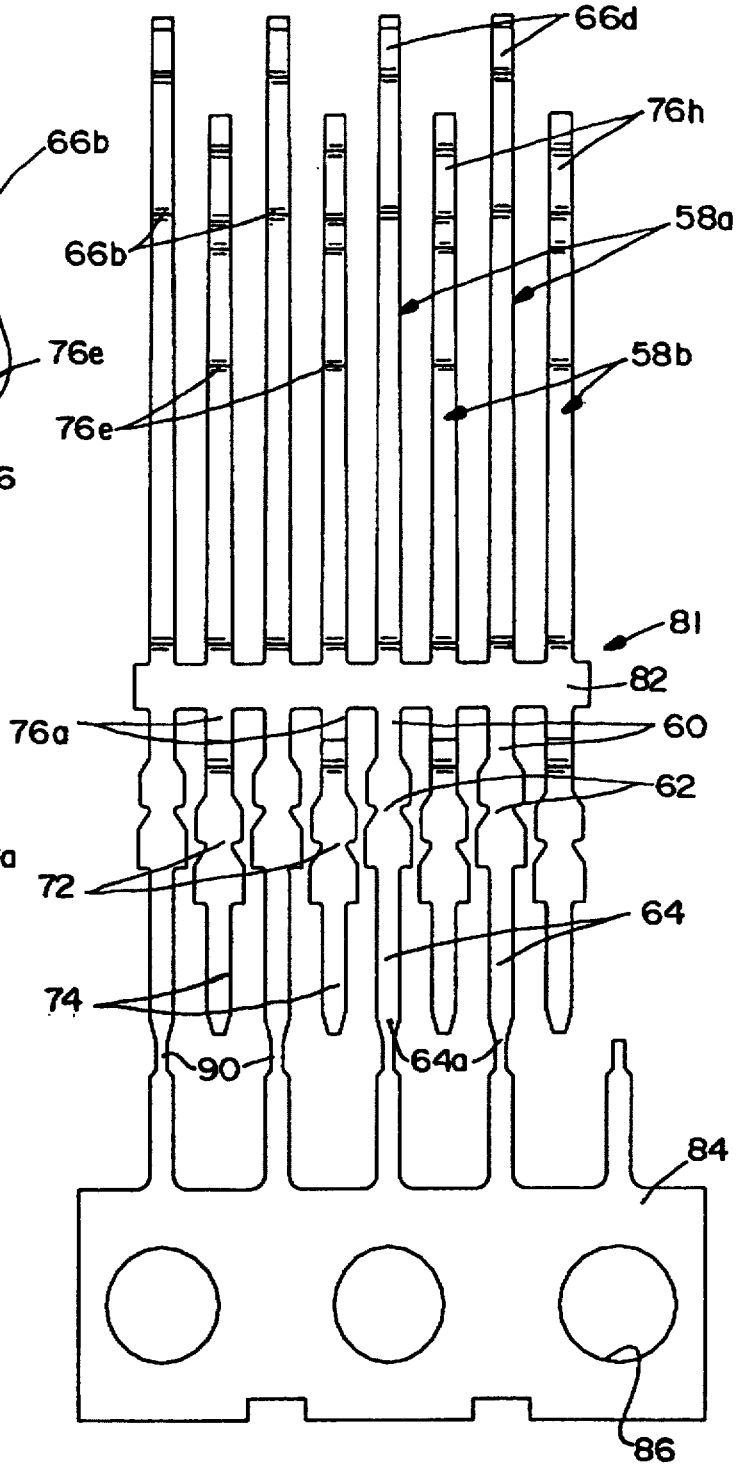
FIG. 14 is a plan view of the stamped and formed strip of terminals as shown in FIG. 12.

FIG. 14 shows the elongate strip 81 of FIG. 13 after it has been fully formed. In essence, FIGS. 14 and 15 correspond to the perspective view of FIG. 12. In particular, blank "B" (FIG. 13) is shaped by appropriate forming processes to define the configurations of spring contact portion 66 of terminals 58*a* and spring contact portion 76 of terminals 58*b* as well as base 70 and tail 74 of terminals 58*b*. FIG. 15 clearly shows how the forming of terminals 58*b* is effective to bring the tips 74*a* of tail portions 74 into substantially the same plane as the tips 64*a* of tail portions 64 of terminals 58*a*. In essence, the vertical distance that tail portions 74 of terminals 58*b* extend from mid-carrier strip 82 has been shortened because the portions of terminals 58*b* below the mid-carrier strip are formed relative to second carrier strip 84. FIGS. 12 and 15 clearly show how this forming step is effective to move retention sections 72 and tail portions 74 of terminals 58*b* out of the plane of retention sections 62 and tail portions 64 of terminals 58*a*.

Prior to inserting the terminals into their respective cavities 38*a* and 38*b*, mid-carrier strip 82 is severed. This severing step creates cutoffs 68 and 78. Rather than having to perform a relatively expensive "deburring" process to remove cutoffs 68 and 78, the recesses 46 and 52 of the housing 22 are dimensioned so that recesses 46 and 52 freely accept the protruding cutoffs whereby the cutoffs do not interfere with either insertion of the terminals into their respective cavities or movement of spring contact portion 76 of terminals 58*b* once they are fully inserted. Eventually, either prior to or after insertion of the terminals into their respective cavities, main carrier strip 84 is severed, as at 90 in FIG. 14, to remove the carrier strip from terminals 58*a*.

As stated above, retention bosses 57 are molded integrally with housing 22 in alignment with terminal-receiving passages 38*b*, and the retention bosses actually are "split" portions of housing 22 on opposite sides of terminal-receiving cavities 38b adjacent lower portions of retention sections 72 of terminals 58b. In other words, in order to minimize the vertical amount of housing above board-mounting face 22a utilized to retain terminals 58b (which maximizes the vertical height usable for the contact beam 76 of the terminal 58b), retention bosses 57 extend downward below board-mounting face 22a in order to provide additional material to retain the terminals within the housing. At least portions of the retention sections of terminals 58b may be located in the passages through "split" retention bosses 57. In essence, this enables the retention sections of terminals 58b to project downwardly below bottom board-mounting face 22a of the housing and still be surrounded by sufficient plastic material of the housing to effect a retention function for the terminals between the retention sections and the housing. As a result, a longer portion of terminals 58b may be used for the spring contact portions 76. This concept is more fully disclosed in U.S. Pat. No. 5,378,175, issued Jan. 3, 1995 and assigned to the assignee of the present invention. Of course, it should be understood that, in spite of the different shapes of terminals 58a and 58b, the electrical path lengths from the contact portions to the tails of the terminals are substantially the same.

Figure 16A:
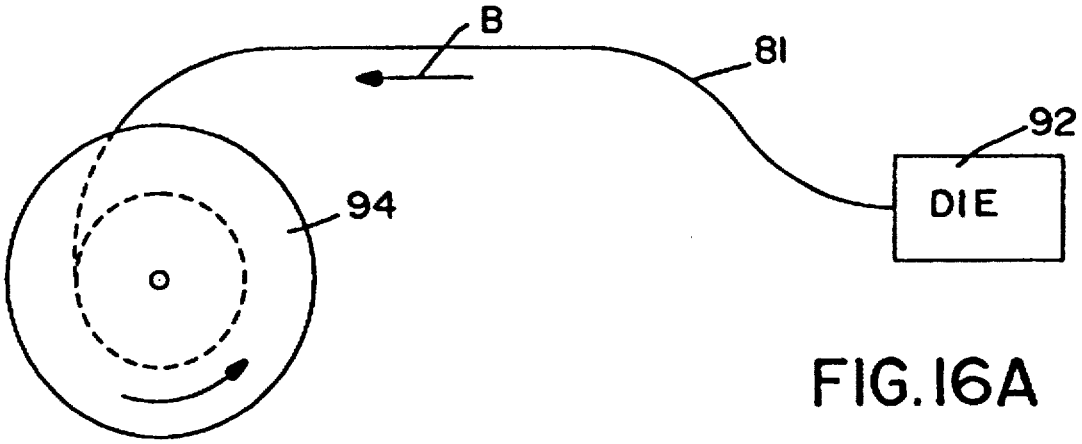
FIGS. 16A–16C are schematic illustrations of processes during the fabrication and subsequent use of the elongate strip of terminals.
Figure 16B:
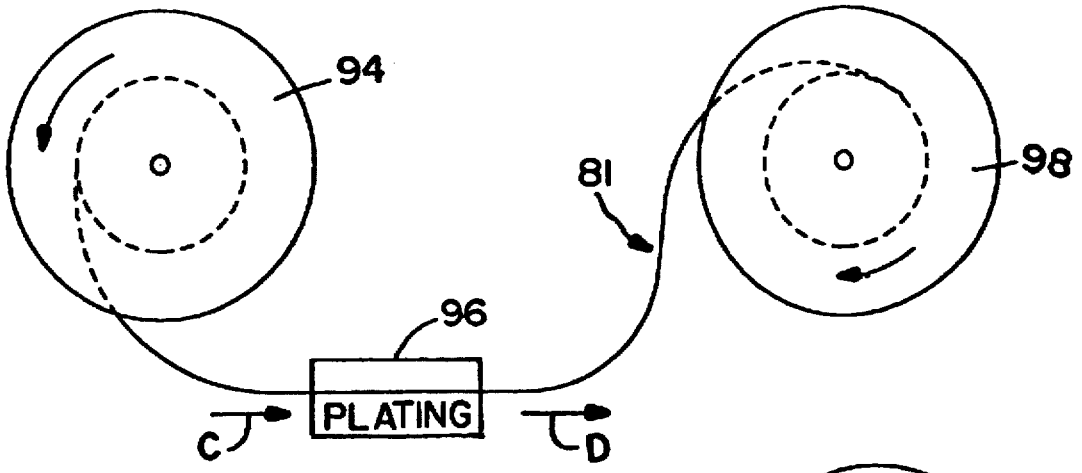
Figure 16C:
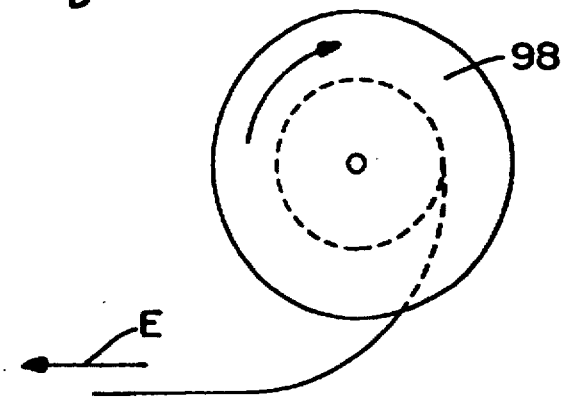

Lastly, FIGS. 16A–16B show how elongate strip 81 of terminals 58a and 58b (shown in FIGS. 12, 14 and 15) comprise an article of manufacture for subsequent operations and/or use. In particular, FIG. 16A shows strip 81 leaving a die 92 after the final step of stamping and forming the strip into the configuration of FIG. 12. The strip is wound onto a reel 94 in the direction of arrow "B" for subsequent processing steps. FIG. 16B shows strip 81 being wound off of reel 94 in the direction of arrow "C" to a plating station 96 whereat certain portions, such as the contact sections of the terminals, are plated with highly conductive material, such as gold. The plated strip then is fed in the direction of arrow "D" onto a second reel 98. This plating operation normally takes place at a different location than the stamping and forming operations as represented by die 92 in FIG. 16A. In fact, the plating operation may take place in different buildings from the stamping and forming operations. Reel 98, with plated strip 81 wound thereon, then may be shipped to a further location as indicated by FIG. 16C where the strip is unwound from reel 98 in the direction of arrow "E" for further use. For instance, the strip may be unwound at its final destination for inserting terminals 58a and 58b into connector housing 22 of connector 20, as described above.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A push-pull edge card electrical connector for receiving an edge of a printed circuit board having contact pads on opposite sides of the board adjacent the edge, comprising:

an elongated dielectric housing including a board-receiving face, an elongated slot disposed in the board-receiving face generally along a longitudinal axis of the housing for receiving said edge of the printed circuit board, a plurality of pairs of transversely spaced apart first and second terminal-receiving cavities for receiving respective ones of a pair of first and second terminals engageable with the contact pads on opposite sides of the printed circuit board and defining two rows of alternating first and second cavities lengthwise of the housing, the first cavity of each pair being located on an opposite side of the slot from said second cavity, the cavities within each row being separated by transverse walls extending generally perpendicular to the longitudinal axis of the housing, and each pair of transversely spaced apart terminal-receiving cavities being disposed between longitudinal side walls of the housing, said side walls being generally parallel to the longitudinal axis, and each said side wall varying in thickness along the length thereof, said side wall having a first thickness at said first terminal-receiving cavities and a second thickness at said second terminal-receiving cavities, said first thickness being greater than said second thickness; and said first and second terminals having different shapes, one of said first terminals being received in each of said first cavities and one of said second terminals being received in each of said second cavities, the first and second terminals alternating lengthwise of the housing in each row of cavities, with the first terminals including retention sections press-fit between the transverse walls adjacent portions of said side walls of said greater thickness.

2. The push-pull edge card electrical connector of claim 1, including reinforcing ribs joining the transverse walls at locations between the transversely spaced terminal-receiving cavities of each pair thereof.

3. The push-pull edge card electrical connector of claim 2 wherein the second terminals include retention sections press-fit between the transverse walls generally adjacent the reinforcing ribs.

4. The push-pull electrical connector of claim 1 wherein said second shape of terminal having a generally planar base portion having said retention section and wherein the spring arm of the second shape of terminal includes a resilient spring arm having a first generally horizontal section extending generally perpendicularly from said base portion, a second generally vertical section extending generally perpendicularly from said first section and offset from the plane of said base portion, a third elongated section extending upward from said second section at an acute angle thereto, a fourth curved contact section extending from said third section and within said slot, a fifth section extending from said fourth contact section and at an obtuse angle relative to said third section, and a distal end including a preload arm positioned against a preload rib of said housing and above said contact section.

5. The push-pull electrical connector of claim 4 wherein said distal end of the spring arm of each said second terminal is generally S-shaped.

6. The push-pull electrical connector of claim 4 wherein said third section of said second terminals is tapered.

7. The push-pull electrical connector of claim 4 wherein said third section of said second terminals extends into the slot and through the plane of said portion.

8. The push-pull electrical connector of claim 4 wherein said distal end of said second terminals includes a sixth curved transition section extending from said fifth section to said preload arm.

9. The push-pull electrical connector of claim 1 wherein said terminals are of a simple cantilevered beam type.

10. A push-pull edge card electrical connector for receiving an edge of a printed circuit board having contact pads on opposite sides of the board adjacent the edge, comprising:

an elongated dielectric housing including a board-receiving face, an elongated slot disposed in the board-receiving face generally along a longitudinal axis of the housing for receiving said edge of the printed circuit board, a plurality of pairs of transversely spaced apart first and second terminal-receiving cavities for receiving respective ones of a pair of first and second terminals engageable with the contact pads on opposite sides of the printed circuit board and defining two rows of alternating first and second cavities lengthwise of the housing, the first cavity of each pair being located on an opposite side of the slot from said second cavity, the cavities within each row being separated by transverse walls extending generally perpendicular to the longitudinal axis of the housing, each cavity having a preload rib extending across said cavity between a pair of said transverse walls generally adjacent said board receiving face and adjacent said slot, each pair of transversely spaced apart terminal-receiving cavities being disposed between longitudinal side walls of the housing, said side walls being generally parallel to the longitudinal axis; and a plurality of pairs of first and second terminals, each pair being received in respective ones of the pairs of transversely spaced apart terminal-receiving cavities, each of the terminals including a generally planar base portion having a retention section for mounting the terminal in a respective one of the terminal-receiving cavities, a tail portion extending from one end of the base portion, and a resilient spring arm having a contact portion extending from an opposite end of the base portion, each spring arm further having a distal end engaging and preloaded against one of said preload ribs, the contact portion of said first terminals being closer to said board receiving face than the contact portion of said second terminals.

11. The push-pull edge card electrical connector of claim 10 wherein tips of said tail portions of the first and second terminals are generally coplanar, and the contact portions of the first terminals extend a greater distance from the plane of said tips than the contact portions of the second terminals.

12. The push-pull edge card electrical connector of claim 10 wherein said preload ribs have different heights generally adjacent and along said slot.

13. The push-pull edge card electrical connector of claim 12 wherein said preload ribs extend inwardly into the cavities from the board-receiving face of the housing.

14. The push-pull edge card electrical connector of claim 10 wherein said first and second cavities are differently shaped.

15. The push-pull electrical connector of claim 10 wherein the spring arm of the second shape of terminal includes a resilient spring arm having a first generally horizontal section extending generally perpendicularly from said base portion, a second generally vertical section extending generally perpendicularly from said first section and offset from the plane of said base portion, a third elongated section extending upward from said second section at an acute angle thereto, a fourth curved contact section extending from said third section and within said slot, a fifth section extending from said fourth contact section to said distal end and at an obtuse angle relative to said third section.

16. The push-pull electrical connector of claim 15 wherein said distal end of the spring arm of each said second terminal is generally S-shaped.

17. The push-pull electrical connector of claim 15 wherein said third section of said second terminals is tapered.

18. The push-pull electrical connector of claim 15 wherein said third section of said second terminals extends into the slot and through the plane of said base portion.

19. The push-pull electrical connector of claim 15 wherein said distal end of said second terminals includes a sixth curved transition section extending from said fifth section to said preload arm.

20. The push-pull electrical connector of claim 10 wherein said terminals are of a simple cantilevered beam type.

* * * * *